US006368135B1

(12) United States Patent
Ho

(10) Patent No.: US 6,368,135 B1
(45) Date of Patent: Apr. 9, 2002

(54) COUPLING DEVICE FOR INTERCONNECTING SLENDER MEMBERS

(75) Inventor: Hsien-Wen Ho, Tainan (TW)

(73) Assignee: Chi-Wen Chen, Taipei (JP)

( * ) Notice: Subject to any disclaimer, the term of this patent is extended or adjusted under 35 U.S.C. 154(b) by 0 days.

(21) Appl. No.: 09/837,086

(22) Filed: Apr. 18, 2001

(51) Int. Cl.[7] ..... H01R 13/62
(52) U.S. Cl. ..... 439/321; 439/318; 285/92
(58) Field of Search ..... 439/312, 313, 439/318, 320, 321; 285/92

(56) References Cited

U.S. PATENT DOCUMENTS 3,881,753 A * 5/1975 Bochory ..... 285/92
4,462,653 A * 7/1984 Flederbach et al. ..... 439/312
4,500,153 A * 2/1985 Mattingly, Jr. et al. ..... 439/313
4,829,223 A * 5/1989 Broberg et al. ..... 320/2
4,990,101 A * 2/1991 Blaisdell ..... 439/320
5,350,201 A * 9/1994 Bynum ..... 285/92

* cited by examiner

*Primary Examiner*—Brian Sircus
*Assistant Examiner*—Thanhi-Tam Le

(57) ABSTRACT

A coupling device for interconnecting first and second slender members includes a positioning sleeve sleeved on one end of the first slender member and having a radial outward stop flange and a radial stop projection at opposite ends thereof. An externally threaded sleeve is sleeved and secured on one end of the second slender member, and has an externally threaded front-end portion. A nut member is sleeved on the positioning sleeve, and has a surrounding wall for engaging the externally threaded sleeve. A limiting member is sleeved between the nut member and the stop projection of the positioning sleeve, thereby arresting movement of the nut member from a fully tightened position.

1 Claim, 9 Drawing Sheets

COUPLING DEVICE FOR INTERCONNECTING SLENDER MEMBERS

BACKGROUND OF THE INVENTION

1. Field of the Invention

The invention relates to a coupling device, more particularly to a coupling device for interconnecting the first and second slender members.

2. Description of the Related Art

FIGS. 1 and 2 illustrate a conventional tube light 1 that comprises a plurality of slender members 11, 12. One of the slender members 11 is provided with a power plug 112. The other slender members 12 serve as lamp sections of the tube light. One of the slender members 11, 12 of an adjacent pair is provided with a pair of pin conductors 132. The other one of the slender members 11, 12 of the adjacent pair is provided with a pair of socket conductors 131 for connecting with the pin conductors 132, thereby establishing electrical connection between the adjacent pair of the slender members 11, 12. The slender members 11, 12 of every adjacent pair are further interconnected by a coupling device 2. Each coupling device 2 includes a positioning sleeve 22, an externally threaded sleeve 21 and a nut member 24. The positioning sleeve 22 is sleeved and secured on one end 122 of a first one of the slender members 12, and has a front end portion formed with a radial outward stop flange 221. The externally threaded sleeve 21 is sleeved and secured on one end 113 of a second one of the slender members 11, and has an externally threaded front end portion 211. The nut member 24 has a base ring portion 241 formed with a through-hole 242 to permit sleeving of the nut member 24 on the positioning sleeve 22, and a surrounding wall portion 243 that extends forwardly from a periphery of the base ring portion 241 and that is formed with an internal screw thread 244 for engaging the externally threaded front end portion 211 of the externally threaded sleeve After bringing the externally threaded sleeve 21 toward the positioning sleeve 22 to interconnect the pin and socket conductors 131, 132, the coupling device 2 can be used to connect the adjacent slender members 11, 12 by engaging the nut member 24 threadedly with the externally threaded sleeve 21 until the base ring portion 241 abuts against the stop flange 221 in a fully tightened position of the nut member 24. A ring gasket 23, which is sleeved on the end 122 of the first one 20 of the slender members 12, abuts sealingly against the stop flange 221 and the front end portion 211 of the externally threaded sleeve 21 for waterproofing purposes. As such, the coupling device 2 can be used to maintain the electrical connection between the 25 adjacent slender members 11, 12.

A main drawback of the conventional coupling device 2 resides in that the nut member 24 is easily moved and loosened. When the nut member 24 is loosened, it will affect the connection between the pin and socket conductors 131, 132, and the ring gasket 23 will be loosely retained between the externally threaded sleeve 21 and the positioning sleeve 22, thereby affecting adversely the waterproofing capability of the coupling device 2.

SUMMARY OF THE INVENTION

Therefore, the main object of the present invention is to provide a coupling device of the above-mentioned type that is capable of overcoming the aforesaid drawbacks commonly associated with the prior art.

Accordingly, the coupling device of the present invention includes a positioning sleeve, an externally threaded sleeve, a nut member and a limiting member. The positioning sleeve is adapted to be sleeved and secured on one end of a first slender member, and has a radial outward stop flange at a front end portion thereof, and a radial outward stop projection at a rear end portion thereof. The stop flange and the stop projection are spaced apart from each other along an axis of the positioning sleeve. The externally threaded sleeve is adapted to be sleeved and secured on one end of a second slender member, and has an externally threaded front end portion. The nut member has a base ring portion sleeved on the positioning sleeve, and a surrounding wall portion extending forwardly from a periphery of the base ring portion. The surrounding wall portion is formed with an internal screw thread for engaging the externally threaded front end portion of the externally threaded sleeve such that the base ring portion abuts against the stop flange in a fully tightened position of the nut member. The limiting member is sleeved on the positioning sleeve, and has a front end face that abuts against the base ring portion of the nut member and a rear end face that abuts against the stop projection, thereby arresting movement of the nut member from the fully tightened position.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
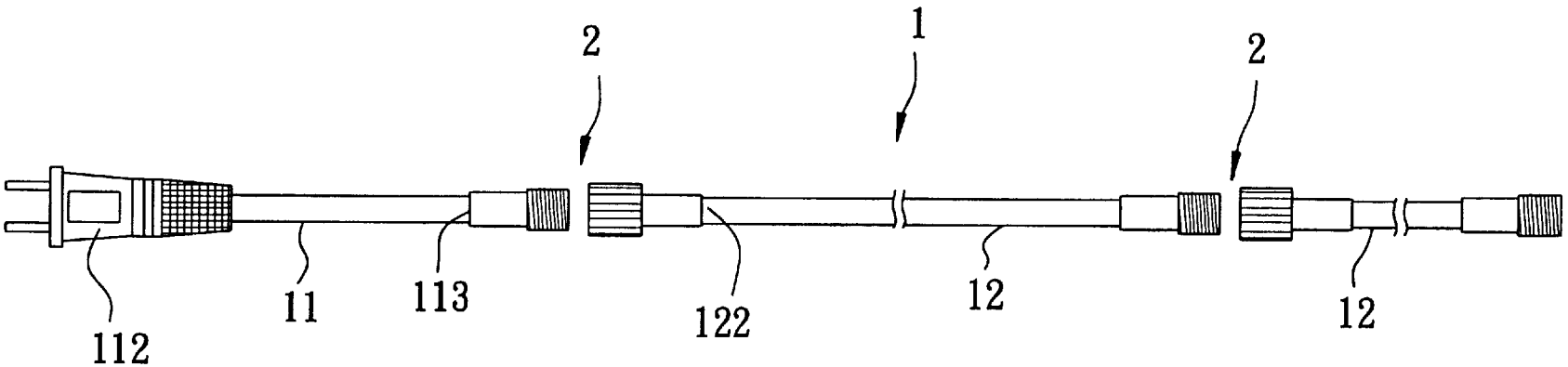
FIG. 1 PRIOR ART
FIG. 1 is an exploded schematic view of a tube light having adjacent slender members interconnected by conventional coupling devices.
Figure 2:
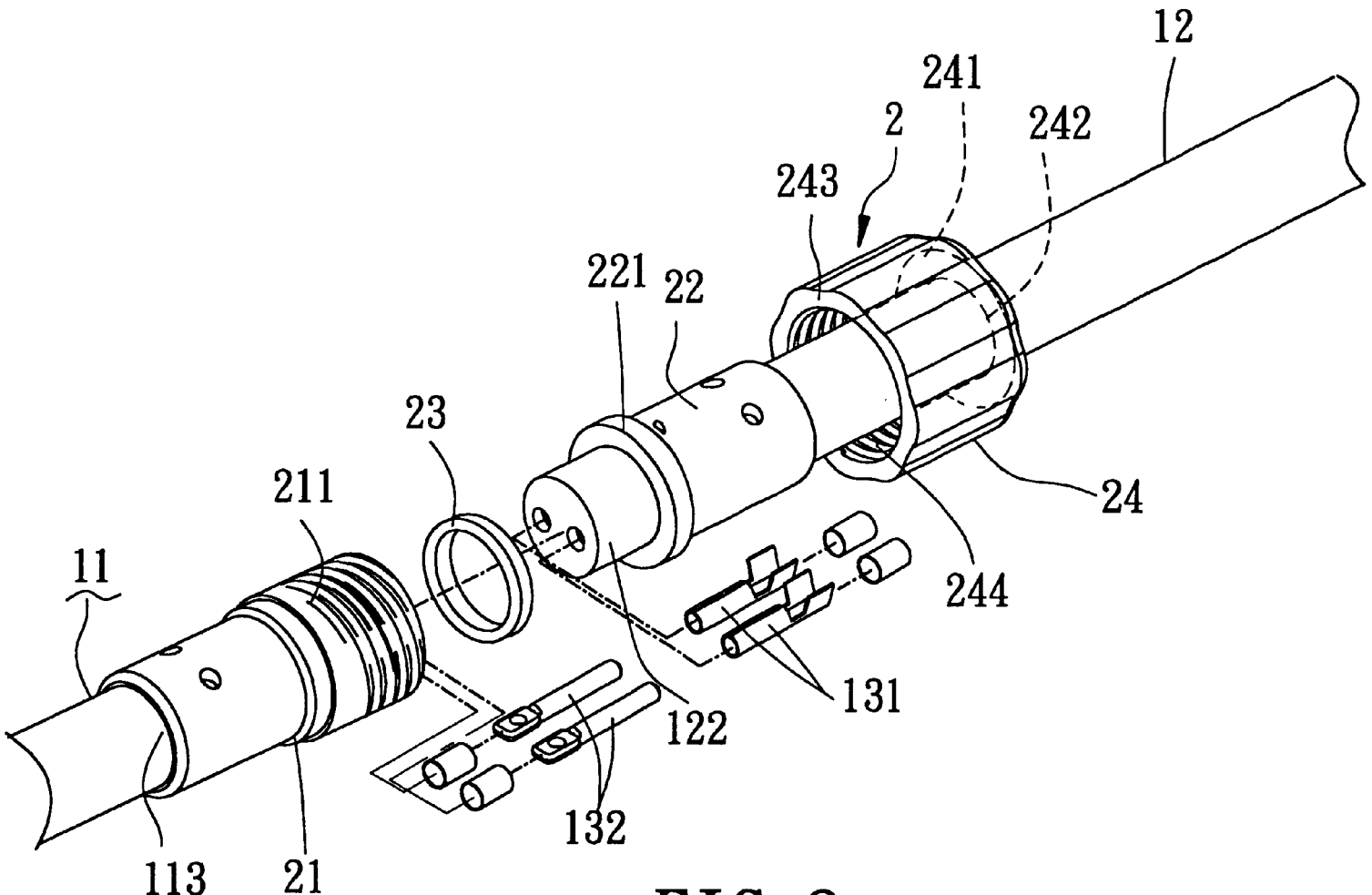
FIG. 2 PRIOR ART
FIG. 2 is an exploded perspective view illustrating a conventional coupling device for interconnecting the adjacent slender members of the tube light of FIG. 1.

Before the present invention is described in greater detail with reference to the following preferred embodiments, it should be noted that like elements are denoted by the same reference numerals throughout the disclosure.

Figure 3:
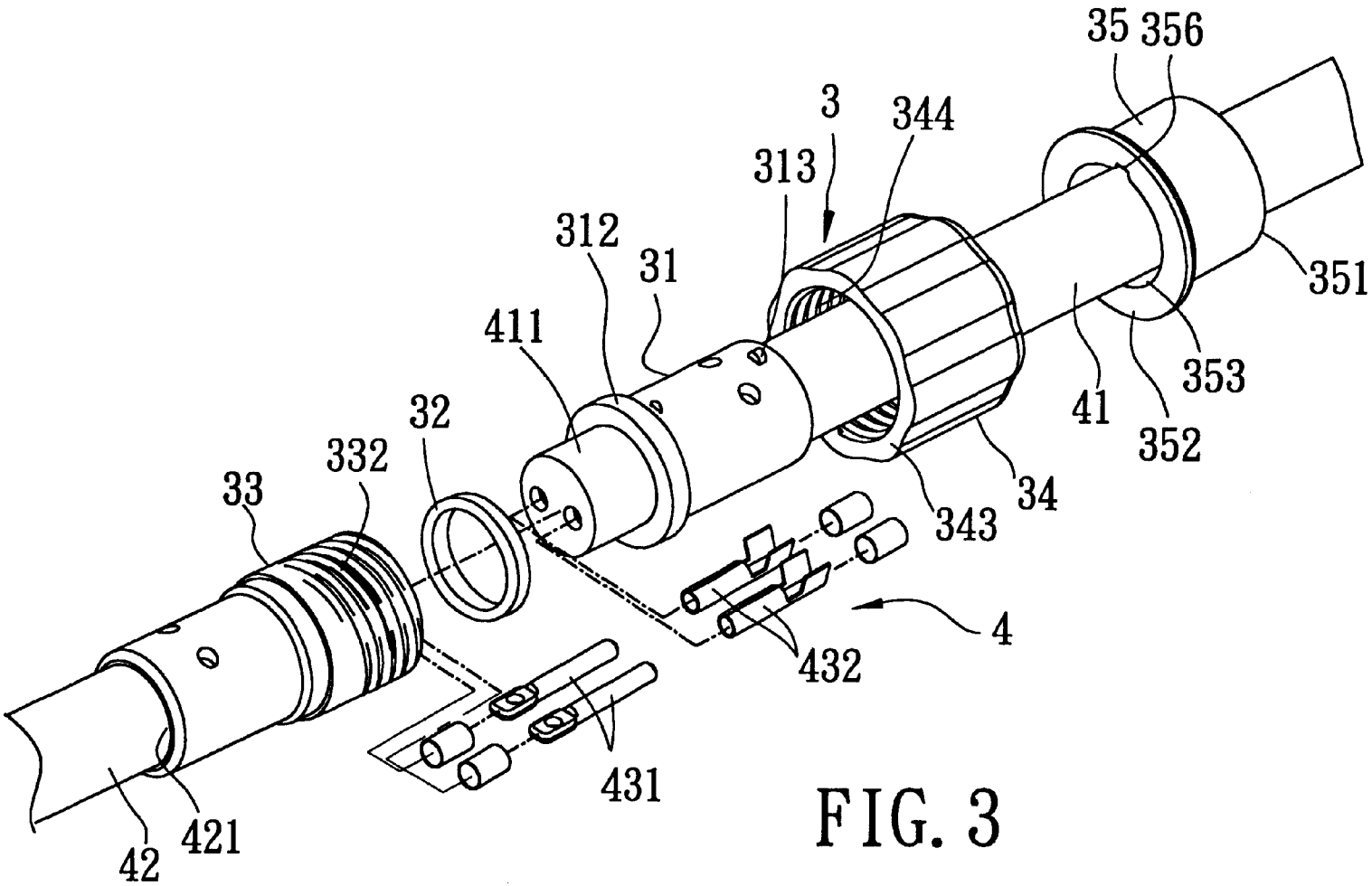
FIG. 3 is an exploded perspective view of the first preferred embodiment of a coupling device for interconnecting adjacent slender members according to the present invention.
Figure 4:
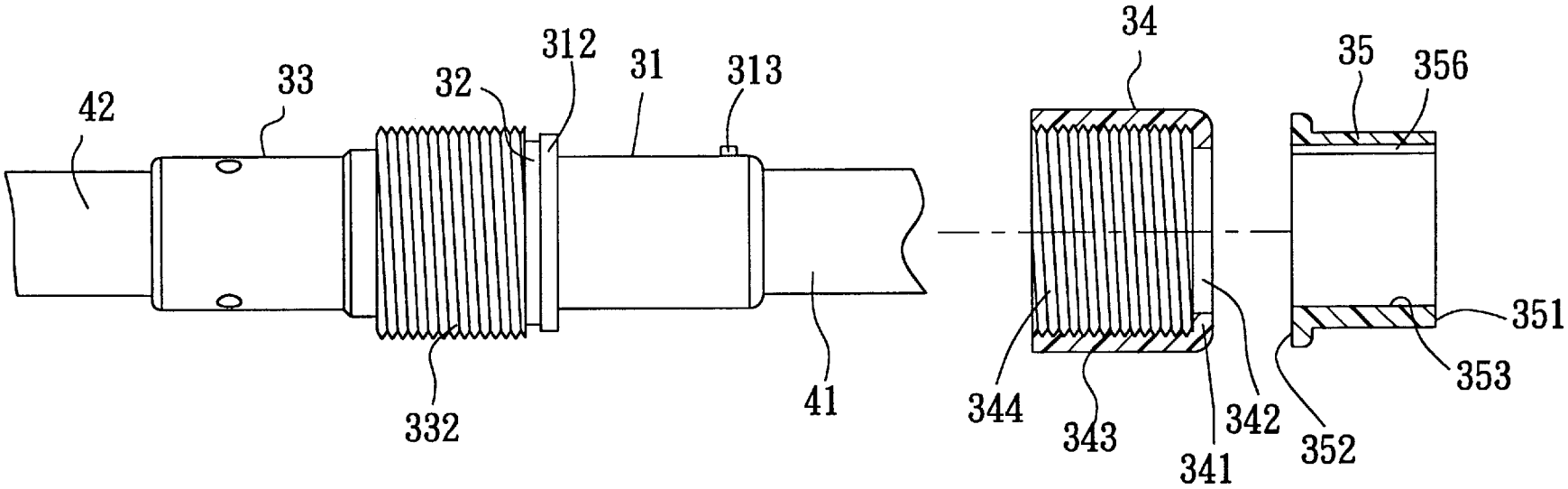
FIG. 4 is a partly sectional exploded schematic view illustrating a nut member and a limiting member when disengaged from a positioning sleeve of the first preferred embodiment.
Figure 5:
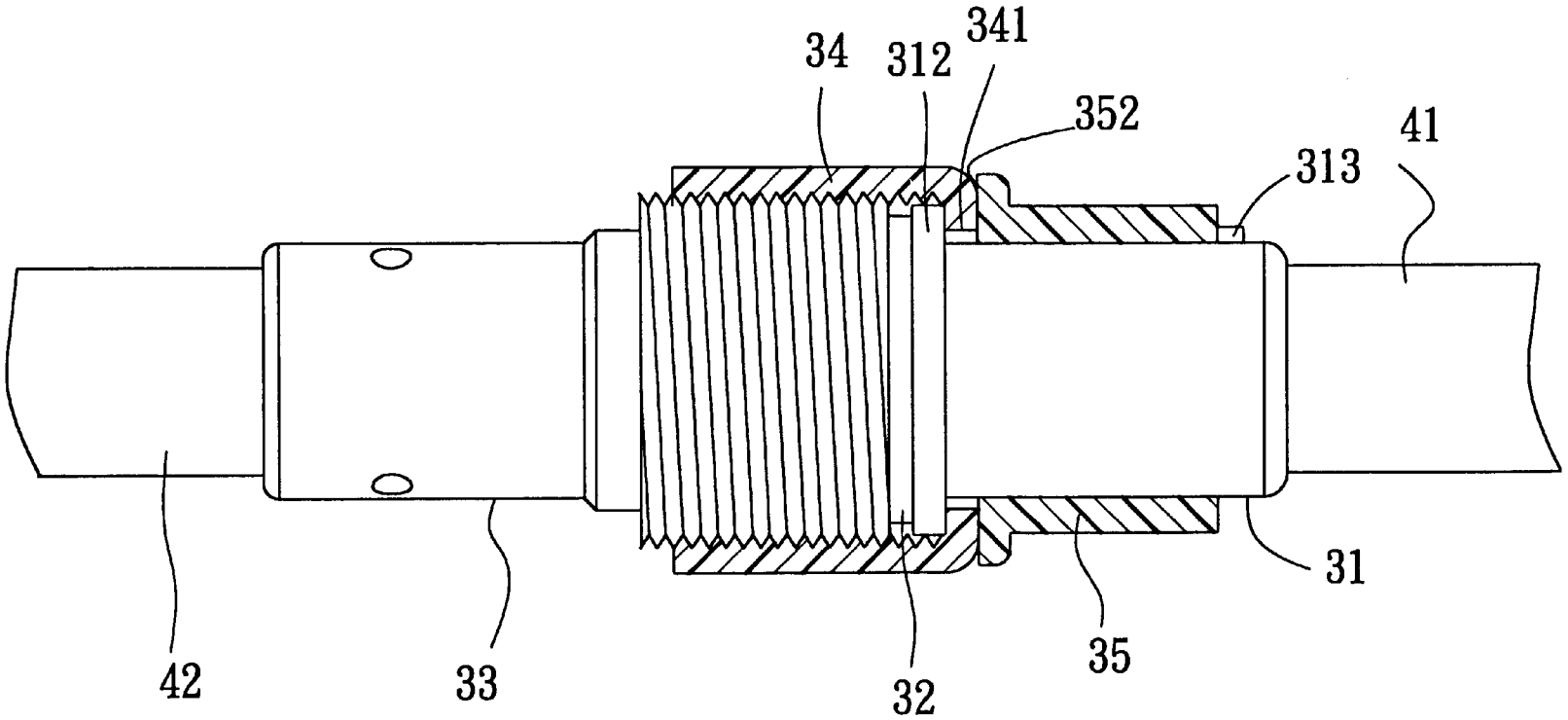
FIG. 5 is a partly sectional schematic view illustrating the nut member and the limiting member when disposed on the positioning sleeve of the first preferred embodiment.

Referring to FIGS. 3, 4 and 5, the first preferred embodiment of a coupling device 3 according to the present invention is shown to be adapted to interconnect adjacent first and second slender members 41, 42 of a known tube light 4. The first slender member 41 has one end 411 provided with a pair of socket conductors 432. The second slender member 42 has one end 421 provided with a pair of pin conductors 431 for connecting with the socket conductors 432, thereby establishing electrical connection between the first and second slender members 41, 42. The coupling device 3 comprises a positioning sleeve 31, a ring gasket 32, an externally threaded sleeve 33, a nut member 34, and a limiting member 35.

The positioning sleeve 31 is sleeved and secured on the end 411 of the first slender member 41, and has front end portion formed with a radial outward stop flange 312, and a rear end portion formed with a radial outward stop projection 313. The stop flange 312 and the stop projection 313 are spaced apart from each other along an axis of the positioning sleeve 31. In this embodiment, the stop projection 313 projects from the positioning sleeve 31 by a distance shorter than that of the stop flange 312.

The externally threaded sleeve 33 is sleeved and secured on the end 421 of the second slender member 42, and has an externally threaded front end portion 332.

The ring gasket 32 is sleeved on the end 411 of the first slender member 41 and is to be retained between the stop flange 312 and the front end portion 332 of the externally threaded sleeve 33.

The nut member 34 has a base ring portion 341 and a surrounding wall portion 343 extending forwardly from a periphery of the base ring portion 341. The base ring portion 341 is formed with a through-hole 342, the size of which permits the nut member 34 to be sleeved on the positioning sleeve 31 without being blocked by the stop projection 313 and permits the base ring portion 341 to abut against the stop flange 312. The surrounding wall portion 343 is formed with an internal screw thread 344 for engaging the externally threaded front end portion 332 of the externally threaded sleeve 33 such that the base ring portion 341 abuts against the stop flange 312 in a fully tightened position of the nut member 34, as shown in FIG. 5.

Figure 6:
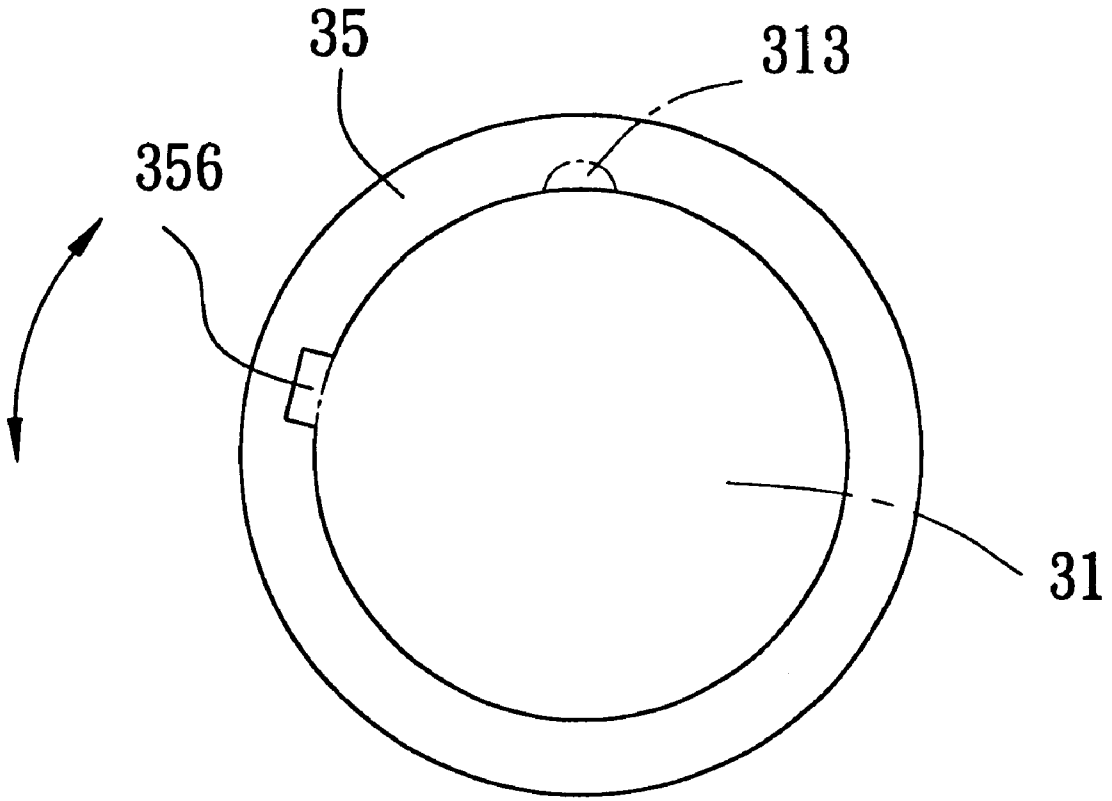
FIG. 6 is a schematic view to illustrate a position relationship between the positioning sleeve and the limiting member according to the first preferred embodiment.

The limiting member 35 is also sleeved on the positioning sleeve 31, and has a front end face 352 that abuts against the base ring portion 341 of the nut member 34 and a rear end face 351 that abuts against the stop projection 313, thereby arresting movement of the nut member 34 from the fully tightened position. In this embodiment, the limiting member 35 is formed as a tubular sleeve that is sleeved rotatably on the positioning sleeve 31. The limiting member 35 has an inner wall surface 353 that is formed with a slide groove 356. The slide groove 356 extends axially from the front end face 352 through the rear end face 351 of the limiting member 35. In this embodiment, the sum of the thickness of the base ring portion 341 of the nut member 34 and the length of the limiting member 35 is preferably equal to the distance between the stop flange 312 and the stop projection 313. With further reference to FIG. 6, the limiting member 35 is rotatable about the axis of the positioning sleeve 31 from a first position, where the slide groove 356 is aligned axially with the stop projection 313 and permits movement of the stop projection 313 therethrough so as to permit sleeving of the limiting member 35 on the positioning sleeve 31 and so as to further permit removal of the limiting member 35 from the positioning sleeve 31, and a second position where the slide groove 356 is misaligned axially with the stop projection 313 so as to prevent removal of the limiting member 35 from the positioning sleeve 31 when the limiting member 35 is sleeved on the positioning sleeve 31.

In use, after bringing the externally threaded sleeve 33 toward the positioning sleeve 31 to interconnect the pin and socket conductors 431, 432, the coupling device 3 can be used to connect the adjacent slender members 41, 42 by engaging the nut member 34 threadedly with the externally threaded sleeve 33 until the base ring portion 341 abuts against the stop flange 312 in a fully tightened position of the nut member 34. The ring gasket 32, which is sleeved on the end 411 of the first slender member 41, abuts sealingly against the stop flange 312 and the front end portion 332 of the externally threaded sleeve 33 for waterproofing purposes. To prevent the nut member 34 from loosening, the limiting member 35 is sleeved on the positioning sleeve 31 by aligning axially the slide groove 356 with the stop projection 313 such that the stop projection 313 is capable of moving along the slide groove 356. When the front end face 352 of the limiting member 35 abuts against the base ring portion 341 of the nut member 34, the stop projection 313 is disposed outside the slide groove 356 behind the limiting member 35, and the limiting member 35 is rotated to misalign axially the slide groove 356 with the stop projection 313 so as to prevent removal of the limiting member 35 from the positioning sleeve 31 and undesired movement of the nut member 34 from the fully tightened position. Electrical connection between the slender members 41, 42 and the waterproof sealing effect attributed to the ring gasket 32 can thus be ensured with the use of the coupling device 3 of this invention.

To disconnect the first and second slender members 41, 42, the limiting member 35 is rotated so that the slide groove 356 and the stop projection 313 will be axially aligned to permit removal of the limiting member 35 from the positioning sleeve 31. The nut member 34 is then disengaged from the externally threaded sleeve 33 so that the first and second slender members 41, 42 can be pulled apart from each other.

Figure 7:
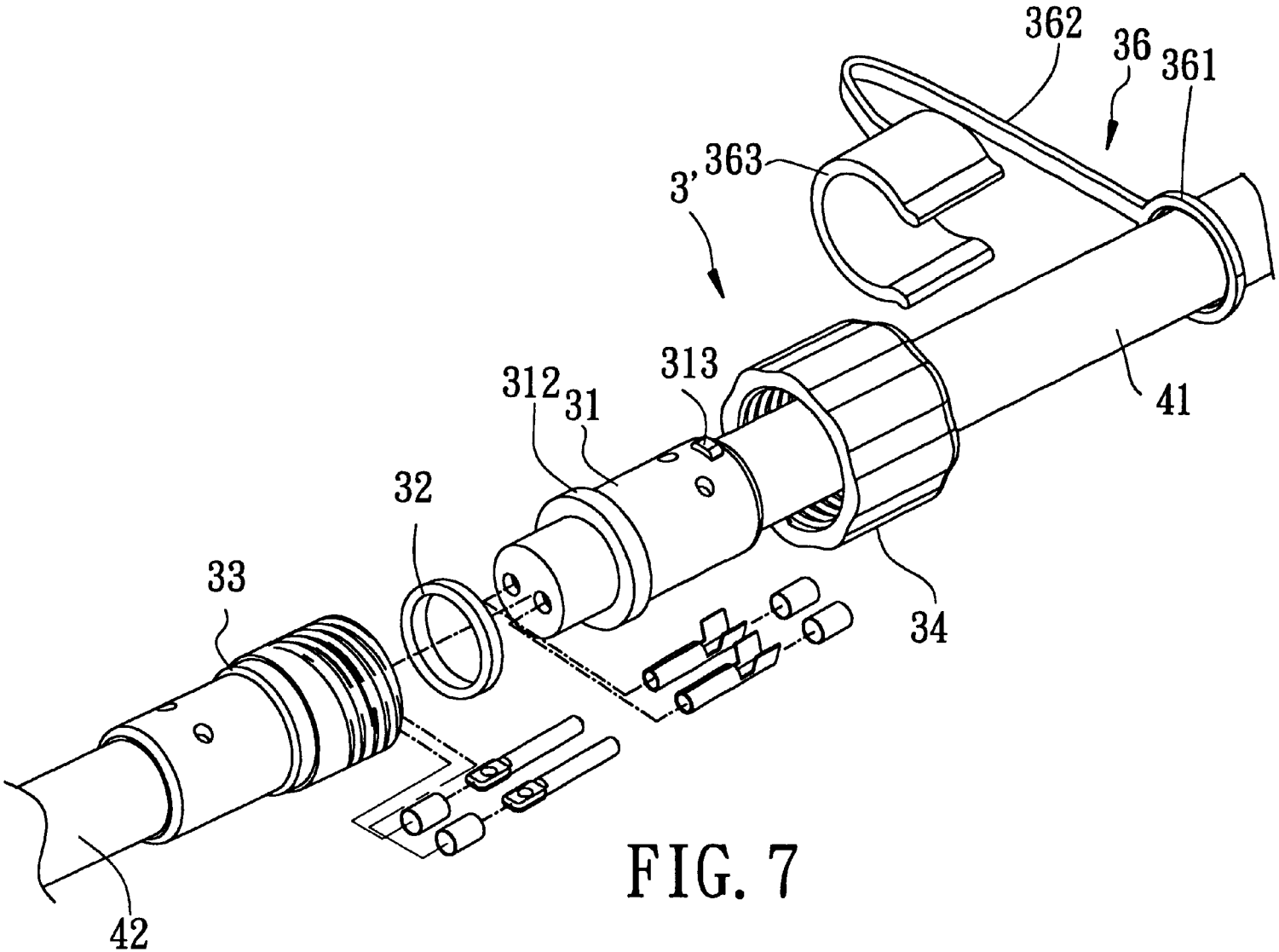
FIG. 7 is an exploded perspective view of the second preferred embodiment of a coupling device for interconnecting adjacent slender members according to the present invention.
Figure 8:
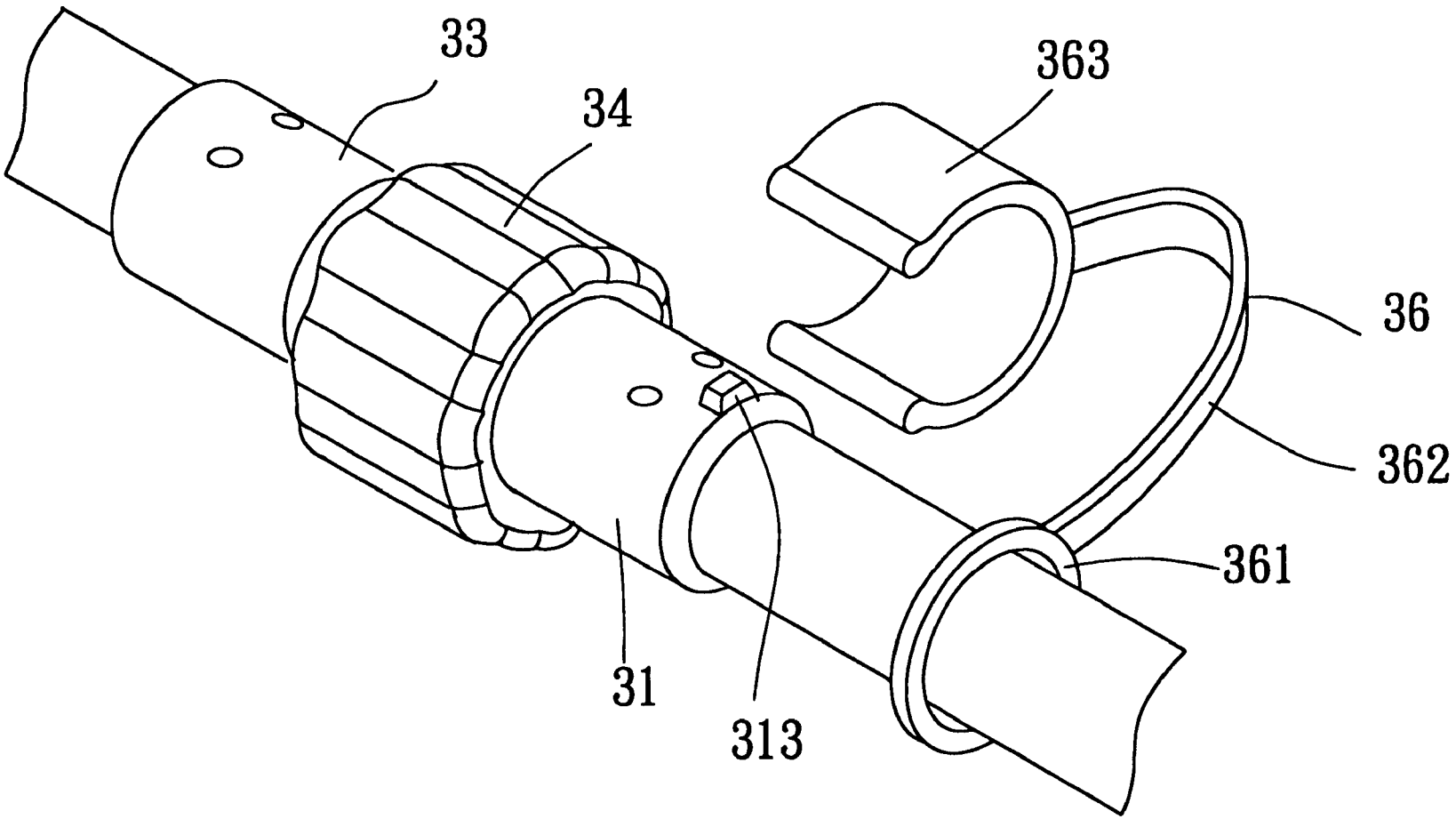
FIG. 8 is a perspective view illustrating a resilient clamp when detached from a positioning sleeve of the second preferred embodiment.

FIGS. 7 and 8 illustrate the second preferred embodiment of a coupling device 3' for interconnecting adjacent slender members 41, 42 according to the present invention. Like the previous embodiment, the coupling device 3' comprises a positioning sleeve 31, a ring gasket 32, an externally threaded sleeve 33, a nut member 34, and a limiting member 36. The main difference between the present and previous embodiments resides in the construction of the limiting member 36. The limiting member 36 includes an anchor ring 361,a flexible strap 362, and a resilient clamp 363. The anchor ring 361 is sleeved on the first slender member 41. The flexible strap 362 has opposite ends connected respectively to the resilient clamp 363 and the anchor ring 361. The resilient clamp 363 has a generally C-shaped cross section for clamping removably the positioning sleeve 31.

Figure 9:
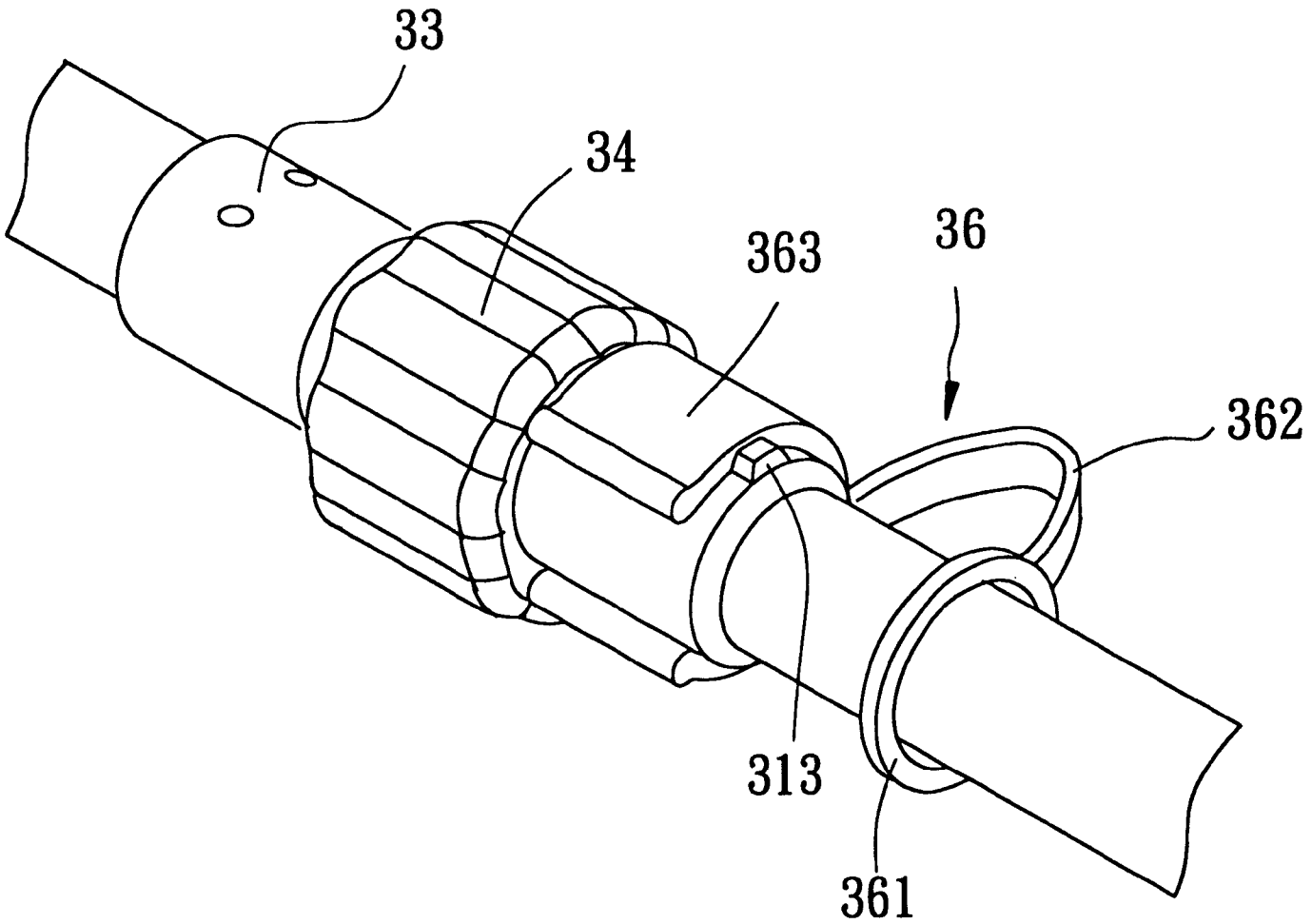
FIG. 9 is a perspective view illustrating the resilient clamp when attached to the positioning sleeve of the second preferred embodiment.

Referring to FIGS. 8 and 9, when the resilient clamp 363 of the limiting member 36 is fastened on the positioning sleeve 31, a front end face of the resilient clamp 363 abuts against the nut member 34, whereas a rear end face of the resilient clamp 363 abuts against the stop projection 313 on the positioning sleeve 31. Thus, the effect of preventing undesired movement of the nut member 34 from the fully tightened position can be similarly achieved in the coupling device 3' of the second preferred embodiment.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A coupling device for interconnecting first and second slender members, comprising:

a positioning sleeve adapted to be sleeved and secured on one end of the first slender member, said positioning sleeve having a front end portion formed with a radial outward stop flange, and a rear end portion formed with a radial outward stop projection, said stop flange and said stop projection being spaced apart from each other along an axis of said positioning sleeve;

an externally threaded sleeve adapted to be sleeved and secured on one end of the second slender member, said externally threaded sleeve having an externally threaded front end portion;

a nut member having a base ring portion sleeved on said positioning sleeve, and a surrounding wall portion extending forwardly from a periphery of said base ring portion, said surrounding wall portion being formed with an internal screw thread for engaging said externally threaded front end portion of said externally threaded sleeve such that said base ring portion abuts against stop flange in a fully tightened position of said nut member; and a limiting member sleeved on said positioning sleeve and having a front end face that abuts against said base ring portion of said nut member and a rear end face that abuts against said stop projection, said limiting member being formed as a tubular sleeve that is sleeved rotatably on said positioning sleeve, said limiting member having an inner wall surface that is formed with a slide groove, said slide groove extending axially from said front end face through said rear end face of said limiting member, said limiting member being rotatable about the axis of said positioning sleeve from a fist position, where said slide groove is aligned axially with said stop projection and permits movement of said stop projection therethrough so as to permit sleeving of said limiting member on said positioning sleeve and so as to further permit removal of said limiting member from said positioning sleeve, and a second position, where said slide groove is misaligned axially with said stop projection so as to prevent removal of said limiting member from said positioning sleeve when said limiting member is sleeved on said positioning sleeve thereby arresting movement of said nut member from the fully tightened position.

* * * * *